US008243002B2

(12) United States Patent
Shin et al.

(10) Patent No.: US 8,243,002 B2
(45) Date of Patent: Aug. 14, 2012

(54) APPARATUS AND METHOD FOR CONTROLLING DISPLAY OF IMAGES

(75) Inventors: Jeong-Hwan Shin, Seongnam-si (KR); Jin-Oh Kwag, Suwon-si (KR); Young-Joo Park, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 734 days.

(21) Appl. No.: 12/220,118

(22) Filed: Jul. 22, 2008

(65) Prior Publication Data

US 2009/0122034 A1 May 14, 2009

(30) Foreign Application Priority Data

Nov. 13, 2007 (KR) ..... 10-2007-0115383

(51) Int. Cl.
*G09G 3/36* (2006.01)
*G09G 5/00* (2006.01)

(52) U.S. Cl. ..... 345/100; 345/204

(58) Field of Classification Search ..... 345/99, 345/100
See application file for complete search history.

(56) References Cited

U.S. PATENT DOCUMENTS

| | | | | |
|---|---|---|---|---|
| 5,315,396 | A * | 5/1994 | Miyadera | 345/98 |
| 7,656,374 | B2 * | 2/2010 | Shen et al. | 345/98 |
| 2004/0239609 | A1 * | 12/2004 | Lee et al. | 345/100 |
| 2007/0126686 | A1 * | 6/2007 | Chang et al. | 345/98 |

* cited by examiner

*Primary Examiner* — Adam J Snyder
(74) *Attorney, Agent, or Firm* — Innovation Counsel LLP

(57) ABSTRACT

In a display device, a first frame of input image signals is received by a signal controller, stored in a memory, and applied to rows of pixels while a gate driver scans a gate-on voltage to a gate line in a first mode to select a row of pixels, one row at a time. When a gate driver controller detects that a second frame of image signals is being received by the signal controller, the gate driver controller halts the operation of the gate driver until the second frame of input image signals has all been received by the signal controller and until a scan start signal is detected by the gate driver controller.

24 Claims, 10 Drawing Sheets

APPARATUS AND METHOD FOR CONTROLLING DISPLAY OF IMAGES

CROSS-REFERENCE TO RELATED APPLICATION

This application claims the benefit of priority of Korean Patent Application No. 10-2007-0115383 filed in the Korean Intellectual Property Office on Nov. 13, 2007, the entire contents of which are incorporated herein by reference.

BACKGROUND OF THE INVENTION (a) Field of the Invention

The present invention relates to a display device and a driving apparatus and driving method thereof. More particularly, the present invention relates to a display device for a terminal and a driving apparatus and driving method thereof.

(b) Description of the Related Art

Recently, a chip for playing motion pictures or a camera for recording external images has been mounted to a terminal such a portable phone, a personal portable information terminal, and the like, and the function of displaying the images in the terminal has become important due to the adoption of image communication.

To provide images in the terminals, a display device such as a liquid crystal display, or an organic light emitting device is generally used. The terminal stores input image signals in a graphic memory located in a signal controller, and then the image signals stored in the graphic memory are transmitted to a data driver of the display device. Thus, a gate driver of the display device sequentially selects gate lines through an active element such as a switching element, and the data driver applies data signals corresponding to the image signals transmitted from the graphic memory to data lines whenever respectively selecting the gate lines to transmit the data signals to pixels connected to the selected gate lines. Next, each pixel stores the data signals to a storing element such as a capacitor and displays the images according to the stored data signals.

Here, the frequency with which the input image signals are stored to the graphic memory may be different from the frequency with which the image signals are transmitted to the data driver from the graphic memory. However, if the two frequencies are different from each other, new image signals may be stored to the graphic memory during the time that the data signals are stored to the pixels according to the sequential selection of the plurality of gate lines. Thus, the graphic memory may transmit the new image signals to the data driver before selecting all the gate lines. Accordingly, the pixels connected to the selected gate line display the previous image before the graphic memory transmits the new image signals to the data driver, and the pixels connected to the newly selected gate line display a new image. Accordingly, different images are displayed during one frame such that a tearing phenomenon in which a portion of the screen collapses may be generated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a display device and a driving device and driving method thereof to prevent the tearing phenomenon.

A driving apparatus of a display device including a plurality of pixels respectively having a switching element and displaying images according to data signals, and a plurality of gate lines and data lines respectively connected to the pixels is provided. The driving apparatus includes a data driver, a gate driver, a signal controller, and a gate driver controller. The data driver generates data signals corresponding to input image signals to apply to the data lines. The gate driver sequentially scans a gate voltage set as a gate-on voltage to the gate lines to turn on the switching elements in a first mode, and stops sequential scanning of the gate-on voltage in a second mode. The signal controller receives and processes the input image signals to transmit to the data driver and transmits a control signal to the gate driver, and the gate driver controller controls an operation of the gate driver with the second mode during a time in which the input image signals are input to the signal controller.

The gate driver controller may set the gate voltage as a first voltage to turn off the switching element in the second mode.

The gate driver may apply the gate signal composed of a combination of the gate voltage and a second voltage for turning off the switching element to each gate line, in the first mode, and the first voltage may be the same as the second voltage.

The signal controller may output a clock signal alternately having a high voltage and a low voltage, the gate driver controller may transmit the clock signal to the gate driver in the first mode and stops transmitting the clock signal in the second mode, and the gate driver may generate the gate voltage that is set as the gate-on voltage in synchronization with the clock signal.

The gate driver controller may provide a signal having a constant voltage to the gate driver in substitution for the clock signal in the second mode.

The constant voltage may be a first voltage for turning off the switching element.

The gate driver may apply a gate signal composed of a combination of the second voltage for turning off the switching element and the gate voltage to each gate line in the first mode, and the first voltage may be the same as the second voltage.

The control signal may include a scanning start signal for informing of scanning start, and the gate driver controller may control an operation of the gate driver with the first mode when the input of the input image signals to the signal controller is completed and the scanning start signal is output from the signal controller.

The gate driver controller may control the gate driver with the second mode before the scanning start signal is output from the signal controller after the input of the input image signals to the signal controller is completed.

The gate driver controller may directly detect whether the input image signals are input to the signal controller.

The signal controller may receive and write the input image signals in response to a write signal, and the gate driver controller may detect input of the input image signal by detecting whether the write signal is input to the signal controller.

The signal controller may receive and write the input image signals in response to a register selection signal, and the gate driver controller may detect input of the input image signals by detecting whether the register selection signal is input to the signal controller.

A display device according to the present invention includes a signal controller, a data driver, a data line, a gate line, a pixel, and a gate driver. The signal controller receives and stores input image signals, and the data driver generates a data signal corresponding to the input image signals transmitted from the signal controller. The data line transmits the data signal, and the gate line transmits a gate signal. The pixel receives and stores the data signal from the data line and displays images corresponding to the data signal according to the gate signal, and the gate driver prevents the pixel from receiving the data signal while the input image signals are input to the signal controller.

The pixel may receive the data signal while the gate driver sets the gate signal as a gate-on voltage, and the gate driver may stop setting the gate-on voltage while the input image signals are input to the signal controller.

The pixel may include a switching element that is turned on in response to the gate-on voltage to receive the data signal, and the gate driver may set the voltage of the gate signal as a first voltage for turning off the switching element to stop applying the gate-on voltage while the input image signals are input to the signal controller.

The gate driver may generate the gate signal composed of a combination of a second voltage for turning off the switching element and the gate-on voltage, or a combination of the first voltage and the second voltage, and the gate signal may be composed of the first voltage and the second voltage while the input image signals are input to the signal controller.

The first voltage may be the same as the second voltage.

The signal controller may output a clock signal alternately having a high voltage and a low voltage, the gate driver may generate the gate signal having the gate-on voltage in synchronization with the clock signal when receiving the clock signal, and the display device may further include a gate driver controller applying a signal having a constant voltage to the gate driver while the input image signals are input to the signal controller.

A driving method of a display device according to the present invention includes storing a first data signal corresponding to first input image signals to a pixel, displaying an image according to the stored first data signal, receiving second input image signals, transmitting a second data signal corresponding to the second input image signals to the pixel, continuously displaying the image according to the stored first data signal by allowing the pixel not to receive the second data signal transmitted to the pixel while receiving the second input image signals, and displaying an image according to the second data signal after completion of the receiving of the second input image signals.

The driving method may further include outputting a clock signal alternately having a high voltage and a low voltage. The storing of the first data signal may include transmitting the clock signal to the gate driver, and the continuous displaying of the image may include stopping transmitting the clock signal to the gate driver. The gate driver may set the pixel to store the first data signals in synchronization with the clock signal.

The stopping of transmitting may further include providing a signal having a constant voltage to the gate driver in substitution for the clock signal.

The displaying of the image may include the image according to the second data signal when a scanning start signal for informing of scanning start is output after the receiving of the second input image signals is completed.

The image may be continuously displayed according to the first data signal before the scanning start signal is output after the receiving of the second input image signals is completed.

The receiving of the second input image signals may include determining whether the second input image signal is received by directly detecting the receiving of the second input image signals.

The receiving of second input image signals may include receiving and writing the second input image signals in response to a write signal, and determining whether the second input image signals are received by detecting the input of the write signal.

DETAILED DESCRIPTION OF THE EMBODIMENTS

Figure 1:
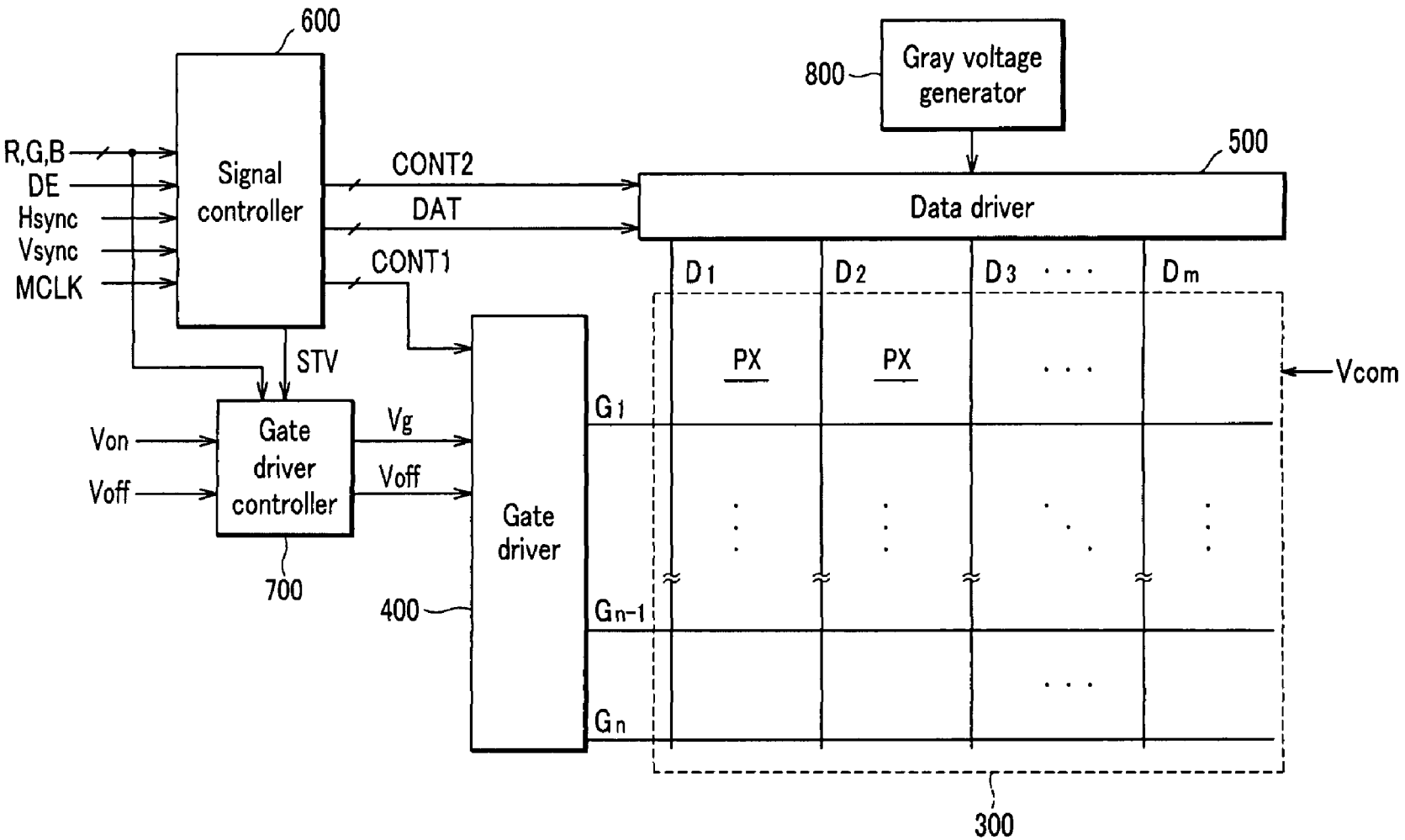
FIG. 1 is a block diagram of a liquid crystal display according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

First, a display device and a driving apparatus and a driving method thereof according to an exemplary embodiment of the present invention will be described in detail, and one example of the display device is a liquid crystal display.

Figure 2:
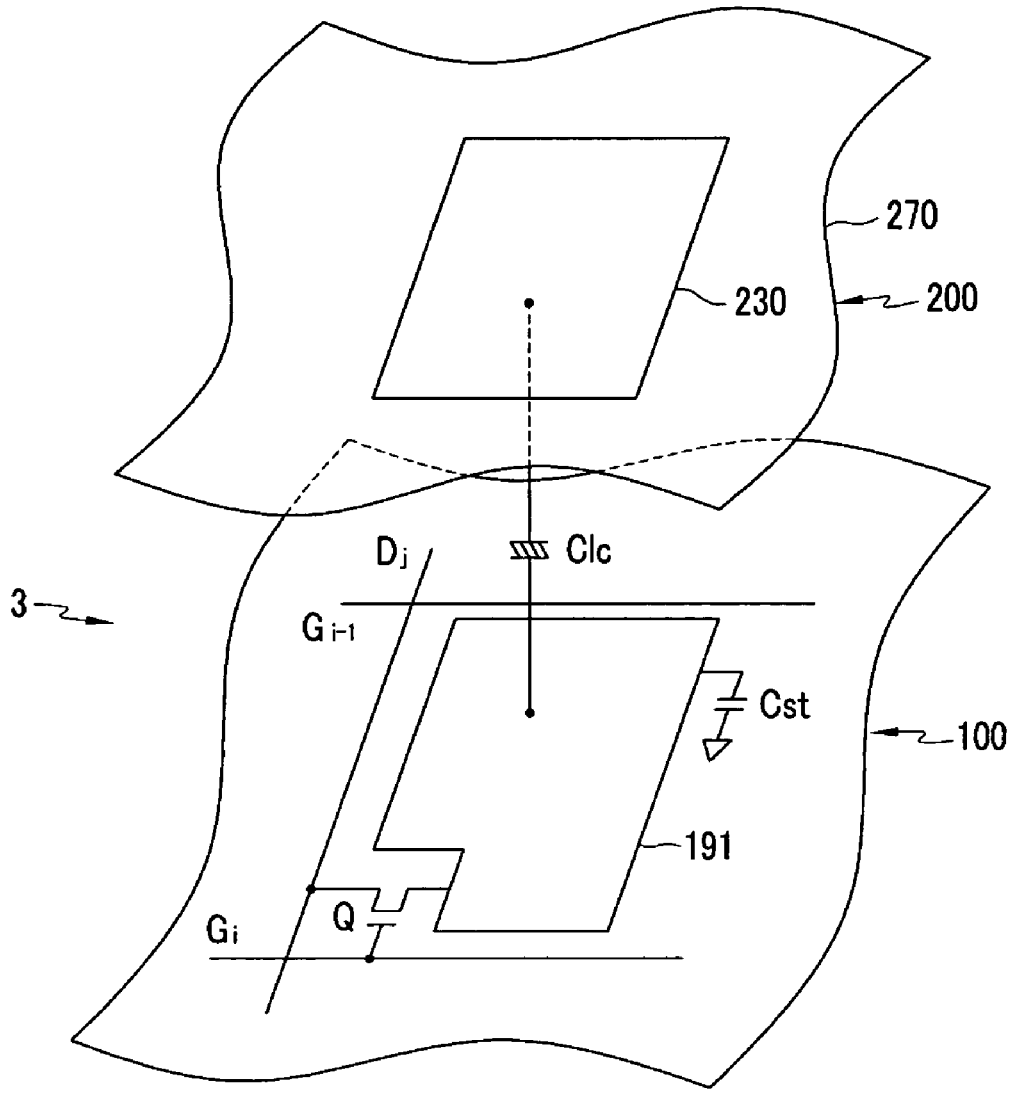
FIG. 2 is an equivalent circuit diagram of one pixel in a liquid crystal display according to an exemplary embodiment of the present invention.

FIG. 1 is a block diagram of a liquid crystal display according to an exemplary embodiment of the present invention, and FIG. 2 is an equivalent circuit diagram of one pixel in the liquid crystal display according to an exemplary embodiment of the present invention.

Referring to FIG. 1, a liquid crystal display according to an exemplary embodiment of the present invention includes a liquid crystal panel assembly 300, a gate driver 400, a data driver 500, a gray voltage generator 800, a signal controller 600, and a gate driver controller 700. The liquid crystal panel assembly 300 may hereinafter be referred to as the display panel assembly 300. The gate driver 400, the data driver 500, the signal controller 600, and the gate driver controller 700 may be considered as portions of a driving apparatus for the liquid crystal display.

In an equivalent circuit, the liquid crystal panel assembly 300 includes a plurality of signal lines $G_1$-$G_n$ and $D_1$-$D_m$, and a plurality of pixels PX that are connected to the plurality of signal lines and are arranged in an approximate matrix shape. Meanwhile, referring to the structure shown in FIG. 2, the liquid crystal panel assembly 300 includes lower and upper display panels 100 and 200 that face each other, and a liquid crystal layer 3 that is interposed between the lower and upper display panels 100 and 200.

The signal lines $G_1$-$G_n$ and $D_1$-$D_m$ include a plurality of gate lines $G_1$-$G_n$ that transmit gate signals (also referred to as "scanning signals") and a plurality of data lines $D_1$-$D_m$ that transmit data signals, i.e., data voltages. The gate lines $G_1$-$G_n$ extend substantially in a row direction and are parallel with one another, and the data lines $D_1$-$D_m$ extend substantially in a column direction and are parallel with one another.

Each pixel, for example a pixel PX connected to an i-th (i=1, 2, . . . , n) gate line $G_i$ and a j-th (j=1, 2, . . . , m) data line $D_j$, includes a switching device Q that is connected to signal lines $G_i$ and $D_j$, a liquid crystal capacitor Clc that is connected to the switching device Q, and a storage capacitor Cst. The storage capacitor Cst may be omitted if necessary.

The switching element Q is a three-terminal element included in the lower display panel 100, such as a thin film transistor. In the switching element Q, a control terminal is connected to a gate line Gi, an input terminal is connected to a data line Dj, and an output terminal is connected to the liquid crystal capacitor Clc and the storage capacitor Cst.

The liquid crystal capacitor Clc has a pixel electrode 191 of the lower display panel 100 and a common electrode 270 of the upper display panel as two terminals, and the liquid crystal layer 3 between the two electrodes 191 and 270 functions as a dielectric. The pixel electrode 191 is connected to the switching device Q. The common electrode 270 is formed on the whole surface of the upper display panel 200, and a common voltage Vcom is applied to the common electrode 270. The common electrode 270 may be included in the lower display panel 100, differently from the case illustrated in FIG. 2, and in that case, at least one of the two electrodes 191 and 270 may be formed in a shape of a line or a bar.

The storage capacitor Cst that serves as an auxiliary to the liquid crystal capacitor Clc is formed as a separate signal line (not shown) provided on the lower panel 100 and the pixel electrode 191 overlapping it with an insulator interposed therebetween, and a predetermined voltage such as the common voltage Vcom or the like is applied to the separate signal line. Also, the storage capacitor Cst can be formed as the pixel electrode 191 overlaps with the immediately previous gate line $G_{i-1}$ by the medium of an insulator.

Meanwhile, in order to realize a color display, each pixel PX specifically displays one of the primary colors (spatial division), or the pixels PX alternately display the primary colors over time (temporal division), which causes the primary colors to be spatially or temporally synthesized, thereby displaying a desired color. An example of the primary colors is a set of three primary colors including red, green, and blue. FIG. 2 is an example of the spatial division. As shown in the figure, each of the pixels PX includes a color filter 230 representing one of the primary colors and the color filter 230 is disposed in a region of the upper display panel 200 corresponding to a pixel electrode 191. Unlike the exemplary embodiment shown in FIG. 2, the color filter 230 may be formed above or below the pixel electrode 191 of the lower display panel 100.

At least one polarizer (not shown) for polarizing light is attached to an outer surface of the liquid crystal panel assembly 300.

Referring to FIG. 1 again, the gray voltage generator 800 generates all gray voltages or a limited number of gray voltages (hereinafter referred to as "reference gray voltages") related to the transmittance of the pixels PX. The (reference) gray voltages may include gray voltages that have a positive value and gray voltages that have a negative value with respect to the common voltage Vcom.

The gate driver 400 is connected to the gate lines $G_1$-$G_n$ of the display panel assembly 300 and synthesizes a gate-on voltage Von and a gate-off voltage Voff to generate gate signals, which are applied to the gate lines $G_1$-$G_n$. Here, the gate voltage Vg may be the gate-on voltage Von or the gate-off voltage Voff according to the operation of the liquid crystal display. The gate-on voltage Von is a voltage for turning on the switching element Q of the pixel PX, and the gate-off voltage Voff is a voltage for turning off the switching element Q of the pixel PX. For example, when the switching element Q is an n-channel transistor, the gate-on voltage Von is a high voltage, and the gate-off voltage Voff is set as a low voltage.

The data driver 500 is connected to the data lines $D_1$-$D_m$ of the display panel assembly 300, and selects gray voltages supplied from the gray voltage generator 800 and then applies the selected gray voltages to the data lines $D_1$-$D_m$ as data voltages. However, in the case in which the gray voltage generator 800 supplies only a limited number of reference gray voltages rather than supplying all gray voltages, the data driver 500 divides the reference gray voltages to generate desired data voltages.

The signal controller 600 controls the gate driver 400 and the data driver 500, and includes a graphic memory (not shown) for storing input image signals.

The gate driver controller 700 detects receives the input image signals R, G, and B that are also input to the signal controller 600. The gate driver controller 700 also receives gate-on Von and gate-off Voff from voltages sources (not shown). The gate driver controller 700 outputs a gate voltage Vg to the gate driver 400. In a first mode of operation (to be described later) of liquid crystal display, the gate driver controller sets the gate voltage Vg equal to the gate-on voltage Von. In a second mode of operation (to be described later) of the liquid crystal display, the gate driver controller 700 sets the gate voltage Vg equal to the gate-off voltage Voff. The gate driver controller also outputs the gate-off voltage Voff separately to the gate driver 400. The gate voltage Vg and the gate-off voltage Voff are required in the operation of the gate driver 400.

Each of the driving circuits 400, 500, 600, and 800 may be directly mounted as at least one integrated circuit (IC) chip on the display panel assembly 300 or on a flexible printed circuit film (not shown) in a tape carrier package (TCP), which are attached to the display panel assembly 300, or may be mounted on a separated printed circuit board (not shown). Alternatively, the driving circuits 400, 500, 600, and 800 may be integrated with the display panel assembly 300 along with the signal lines $G_1$-$G_n$ and $D_1$-$D_m$ and the TFT switching elements Q. Further, the driving circuits 400, 500, 600, and 800 may be integrated as a single chip. In this case, at least one of them or at least one circuit device constituting them may be located outside the single chip.

Now, the operation of the above-described liquid crystal display will be explained in detail.

The signal controller 600 is supplied with input image signals R, G, and B and input control signals for controlling the display thereof from an external graphics controller (not shown) or a camera (not shown). The input image signals are stored in a graphic memory (not shown) in the signal controller 600. The input image signals R, G, and B contain luminance information for each pixel (PX). The luminance has a predetermined number of grays, such as 1024 ($=2^{10}$), 256 ($=2^8$), or 64 ($=2^6$). The input control signals include, for example, a vertical synchronization signal Vsync, a horizontal synchronization signal Hsync, a main clock signal MCLK, and a data enable signal DE.

Here, the liquid crystal display is operated in a first mode using the input image signals R, G, and B stored in the signal controller 600 and in a second mode in which new input image signals are input to the input signal controller 600. The operation of the liquid crystal display in the first mode and in the second mode will be explained below.

The signal controller 600 processes the input image signals R, G, and B in such a way as to generate a processed image signal suitable for the operating conditions of the liquid crystal panel assembly 300 based on the input image signals R, G, and B and the input control signals. The signal controller 600 generates a gate control signal CONT1, a data control signal CONT2, and a processed image signal DAT, and it sends the gate control signal CONT1 to the gate driver 400 and the data control signal CONT2 and the processed image signal DAT (hereinafter called image signal DAT) to the data driver 500.

The gate control signal CONT1 includes a scan start signal STV for indicating scan start, and at least one clock signal for controlling an output period of the gate-on voltage Von. The gate control signal CONT1 may further include an output enable signal OE for limiting the time duration of the gate-on voltage Von.

The data control signal CONT2 includes a horizontal synchronization start signal STH for indicating initiation of data transmission of the image signals DAT to the data driver 500 for a row (group) of pixels PX, a load signal LOAD for requesting the data driver 500 to apply analog data voltages to the data lines $D_1$-$D_m$, and a data clock signal HCLK. The data control signal CONT2 may further include a reverse signal RVS for inverting voltage polarity of the data voltage with respect to the common voltage Vcom (hereinafter, "voltage polarity of the data voltage with respect to the common voltage" is abbreviated to "polarity of the data voltage").

Responsive to the data control signal CONT2 from the signal controller 600, the data driver 500 receives image signals DAT for a row (group) of pixels from the signal controller 600, converts the image signals DAT into analog data voltages by selecting gray voltages corresponding to the respective digital image signals DAT, and applies the selected gray voltages as data voltages to the data lines $D_1$-$D_m$.

When the liquid crystal display is operating in the first mode, the gate driver controller 700 sets the gate voltage Vg equal to the gate-on voltage Von and supplies this voltage to the gate driver 400. The gate driver 400 applies the gate voltage, i.e., the gate-on voltage Von to a gate line Gi of $G_1$-$G_n$ in response to the scanning control signals CONT1 from the signal controller 600, thereby turning on the switching transistors Q connected to the gate line Gi. Thus, the data voltages applied to the data lines $D_1$-$D_m$ are supplied to the pixels PX of the gate line Gi through the activated switching transistors Q.

The difference between a data voltage applied to a pixel PX and the common voltage Vcom applied to the common electrode 270 is the charging voltage of the liquid crystal capacitor Clc of the pixel PX, and is referred to as a pixel voltage. The LC molecules in the liquid crystal capacitor Clc have orientations depending on the magnitude of the pixel voltage, and the molecular orientations determine the polarization of light passing through the liquid crystal layer 3. The polarizer (s) converts the light polarization into light transmittance such that the pixel PX has a luminance controlled by the pixel voltage including the gray voltage that corresponds the image signal DAT.

By repeating this procedure in each of a sequence of horizontal periods (also referred to as "1H" and that is equal to one period of the horizontal synchronization signal Hsync and the data enable signal DE), all gate lines $G_1$-$G_n$ are sequentially supplied with the gate-on voltage Von, thereby applying the data voltages to all pixels PX to display a complete image, also called a frame.

When the next frame starts after one frame finishes, the inversion control signal RVS applied to the data driver 500 is controlled such that the polarity of the data voltage applied to each pixel PX is inverted (which is referred to as "frame inversion"). The inversion control signal RVS may also be controlled such that the polarity of the data voltage flowing in the data line is periodically inverted during one frame (for example row inversion and dot inversion), or the polarity of the data voltages applied to one pixel row is inverted (for example column inversion and dot inversion).

Next, the operation of the liquid crystal display in the second mode will be described. The second mode is applied when new input image signals R, G, and B are input to the signal controller 600 during the scanning of the previous input image signals.

When the gate driver controller detects that the input image signals R, G, and B are input to the signal controller 600, the gate driver controller 700 sets the gate voltage Vg equal to the gate-off voltage Voff. In the present exemplary embodiment of the present invention, it is explained that the gate voltage Vg is set equal to the gate-off voltage Voff, but alternatively the gate voltage Vg may be set as a different voltage (i.e., a voltage lower than the gate-on voltage Von) to turn off the switching element Q of the pixel PX. Thus, because the switching elements Q of the pixels PX connected to the gate lines $G_1$-$G_n$ that receive the gate-off voltage Voff as the gate voltage Vg are not turned on, the pixels PX do not receive the data voltages corresponding to the input image signals R, G, and B input to the signal controller 600. Accordingly, the pixels PX display the image for the data voltage stored in the previous frame.

After the step of inputting the input image signals R, G, and B to the signal controller 600 is completed, and the gate driver controller 700 detects that the scanning start signal STV is input from the signal controller 600 to the gate driver 400, the gate driver controller 700 sets the gate voltage Vg as the gate-on voltage Von to again operate the liquid crystal display in the first mode.

Next, a gate driver and a gate driver controller for a liquid crystal display according to an exemplary embodiment of the present invention will be described in detail with reference to FIG. 3 to FIG. 5.

Figure 3:
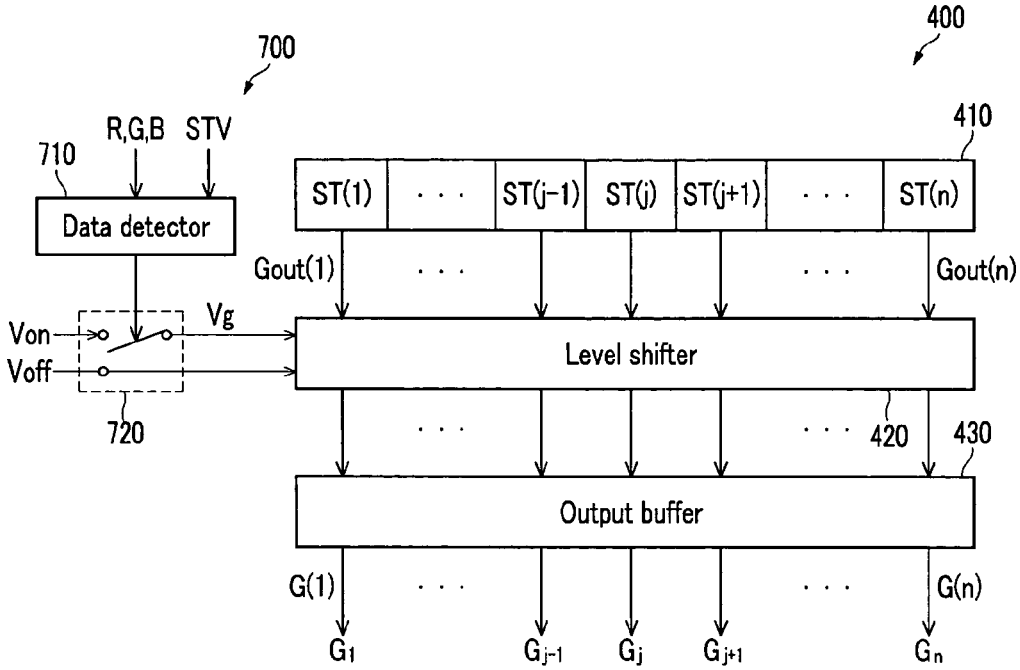
FIG. 3 is a block diagram of a gate driver and a gate driver controller according to an exemplary embodiment of the present invention.
Figure 4:
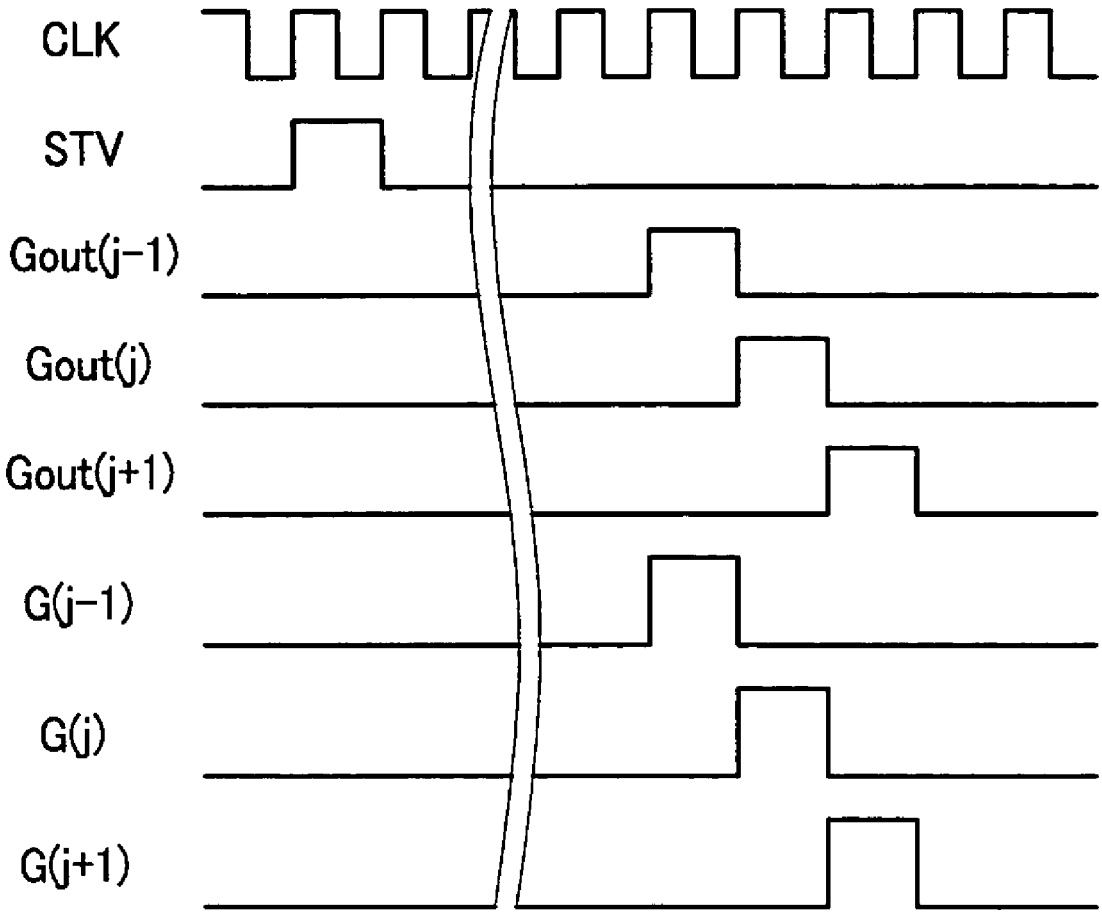
FIG. 4 and FIG. 5 are respectively signal timing diagrams of the gate driver shown in FIG. 3.
Figure 5:
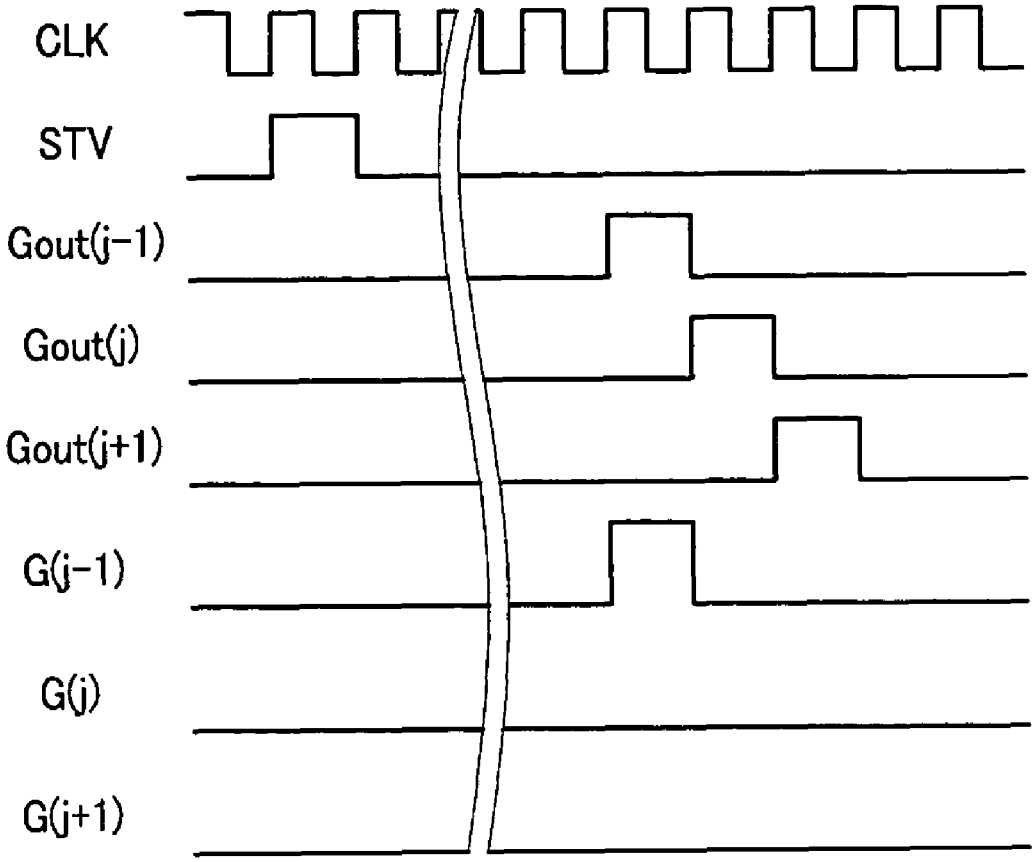

FIG. 3 is a block diagram of a gate driver 400 and a gate driver controller 700 according to an exemplary embodiment of the present invention, and FIG. 4 and FIG. 5 are signal timing charts of the gate driver shown in FIG. 3.

As shown in FIG. 3, the gate driver controller 700 includes a data detector 710 for detecting input image signals R, G, and B that are input to the signal controller 600 from an external source, and a scanning start signal STV that is output from the signal controller 600, and a voltage controller 720 for controlling the gate voltage Vg.

The gate driver 400 includes a shift register 410, a level shifter 420, and an output buffer 430.

The gate driver 400 receives the gate control signal CONT1, which includes the scanning start signal STV and the clock signal from the signal controller 600. The shift register 410 receives the scanning start signal STV and the clock signal CLK. The shift register 410 includes a plurality of stages ST(j) connected to the plurality of gate lines $G_1$-$G_n$ through the level shifter 420 and the output buffer 430.

The level shifter 420 receives the gate voltage Vg and the gate-off voltage Voff from the voltage controller 720, and converts the output of the shift register 410 into the level of the gate voltage Vg and the gate-off voltage Voff and transmits the converted output to the output buffer 430. The output buffer 430 is connected between the level shifter 420 and the gate lines $G_1$-$G_n$ to minimize the influence of the load of the gate lines $G_1$-$G_n$.

Each stage of the shift register includes a set terminal (not shown), an output terminal (not shown), and a clock terminal (not shown). For each stage, for example, the j-th stage ST(j), the set terminal receives a gate output Gout(j−1) from the previous stage ST(j−1), and the clock terminal receives the clock signal CLK from the signal controller 600. Thus, each stage generates a gate output Gout(j) having a high voltage pulse in synchronization with the clock signal CLK input to the clock terminal.

However, the set terminal of the first stage ST(1) receives the scanning start signal STV from the signal controller 600.

The clock signal CLK has a cycle of 1H and a duty ratio of about 50%.

Referring to FIG. 4, the first stage ST(1) outputs the high voltage of the scanning start signal STV as the gate output Gout(1) during a 1H period of the clock signal CLK in response to the high voltage of the clock signal CLK. Each stage, for example the j-th stage ST(j), outputs the high voltage of the previous gate output Gout(j−1) that is the output of the previous stage ST(j−1) as the gate output Gout(j) during a 1H period of the clock signal CLK in response to the high voltage of the clock signal CLK.

In this way, the plurality of stages ST(1) to ST(n) sequentially output the gate outputs Gout(1) to Gout(n) having the high voltage during the 1H period.

The level shifter 420 outputs the gate voltage Vg in response to the high voltage of the gate output Gout(j), and outputs the gate-off voltage Voff in response to the low voltage of the gate output Gout(j). The output buffer 430 respectively supplies the gate signals G(1) to G(n) composed of a combination of the gate voltage Vg and the gate-off voltage Voff that are output from the level shifter 420 to the gate lines $G_1$-$G_n$.

In the first mode of operation, after the input image signals R, G, and B have been completely input to the signal controller 600, and the data detector 710 detects the scanning start signal STV output from the signal controller 600, the voltage controller 720 sets the gate-on voltage Von as the gate voltage Vg to apply it to the gate driver 400.

Accordingly, the gate signals G(1) to G(n) have the combination of the gate-on voltage Von and the gate-off voltage Voff, and the switching element Q of the pixel PX is turned on in response to the gate-on voltage Von of the gate signal applied to the corresponding gate lines $G_1$-$G_n$. Accordingly, the liquid crystal display is operated with the first mode as above-described.

On the other hand, when the data detector 710 detects that the input image signals R, G, and B are input to the signal controller 600, the voltage controller 720 sets the gate-off voltage Voff as the gate voltage Vg to apply it to the gate driver 400 such that the operation of the gate driver 400 is controlled in the second mode.

Here, the data detector 710 directly confirms the input image signals R, G, and B input to the signal controller 600 such that the input of the input image signals R, G, and B can be detected. Alternatively, because a write signal and a register selection signal are input along with the input image signals R, G, and B when the input image signals R, G, and B are input to the signal controller 600, the data detector 710 may confirm the write signal and/or the register selection signal such that the input of the input image signal R, G, and B can be detected. Here, the write signal is a signal for indicating the writing of the input image signals R, G, and B to the graphic memory of the signal controller 600, and the register selection signal is a signal for selecting a register in which to write the input image signals R, G, and B in the graphic memory of the signal controller 600.

In the second mode, the gate-off voltage Voff is set as the gate voltage Vg. As a result, the gate signals G(1) to G(n) are only made of the gate-off voltage Voff such that the switching element Q of the pixel PX is not turned on. Thus, the pixel PX displays the gray level according to the data voltage stored to the liquid crystal capacitor Clc and storage capacitor Cst in the previous frame.

Accordingly, the new input image signal is prevented from being applied to the pixel in the middle of a frame in the case in which the input image signals R, G, and B are newly input to the signal controller 600.

While it has been stated above in regard to FIG. 3 that the gate driver 400 includes the shift register 410, the level shifter 420, and the output buffer 430, the functions of the level shifter 420 and/or output buffer 430 may be included with the shift register 410. If the shift register 410 includes the functions of the level shifter 420, the shift register 410 may respectively receive the gate voltage Vg and the gate-off voltage Voff as the high voltage and the low voltage to generate the gate output.

Next, a display device and a driving method thereof according to another exemplary embodiment of the present invention will be described in detail with reference to FIG. 6 to FIG. 10.

Figure 6:
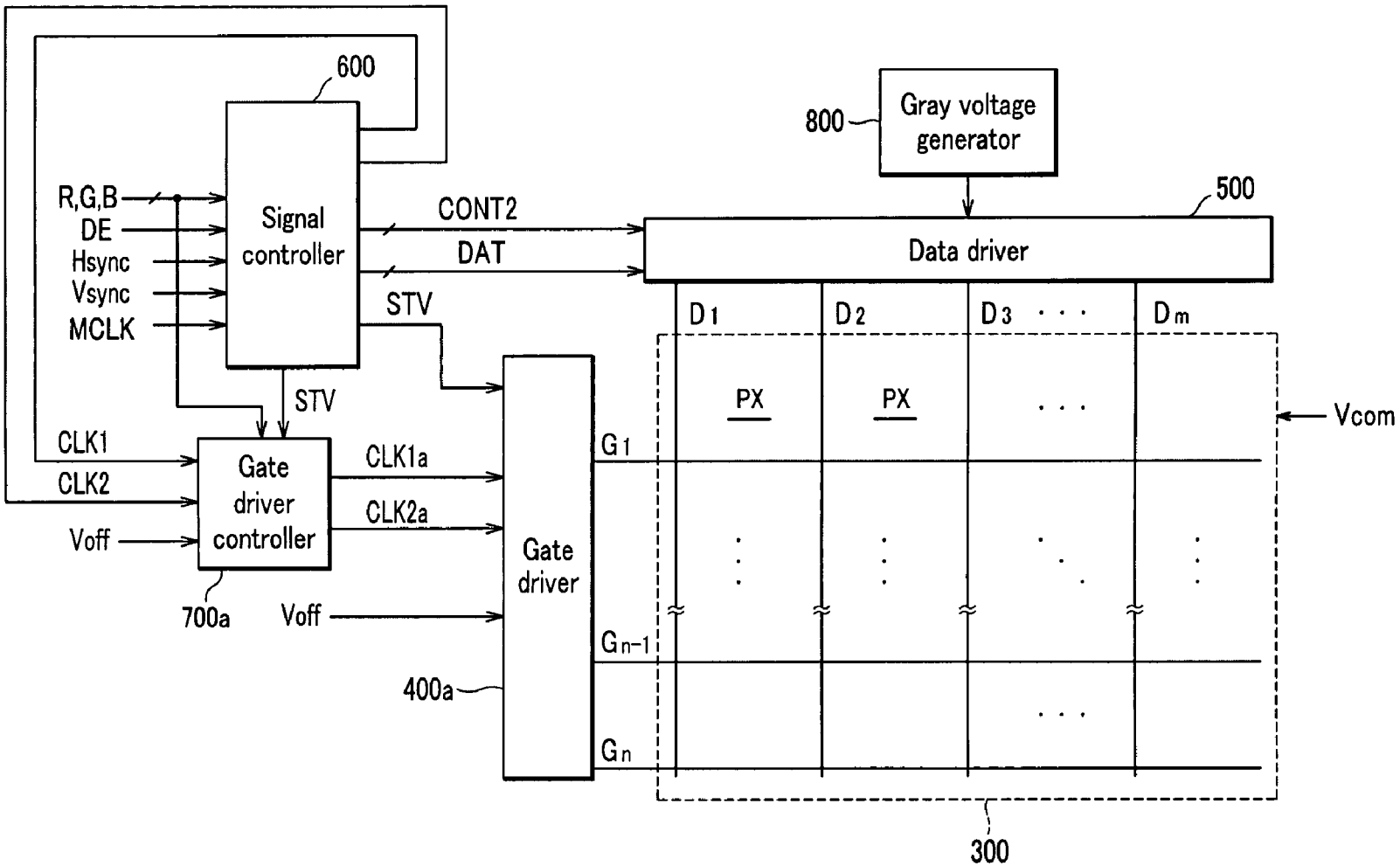
FIG. 6 is a block diagram of a liquid crystal display according to another exemplary embodiment of the present invention.
Figure 7:
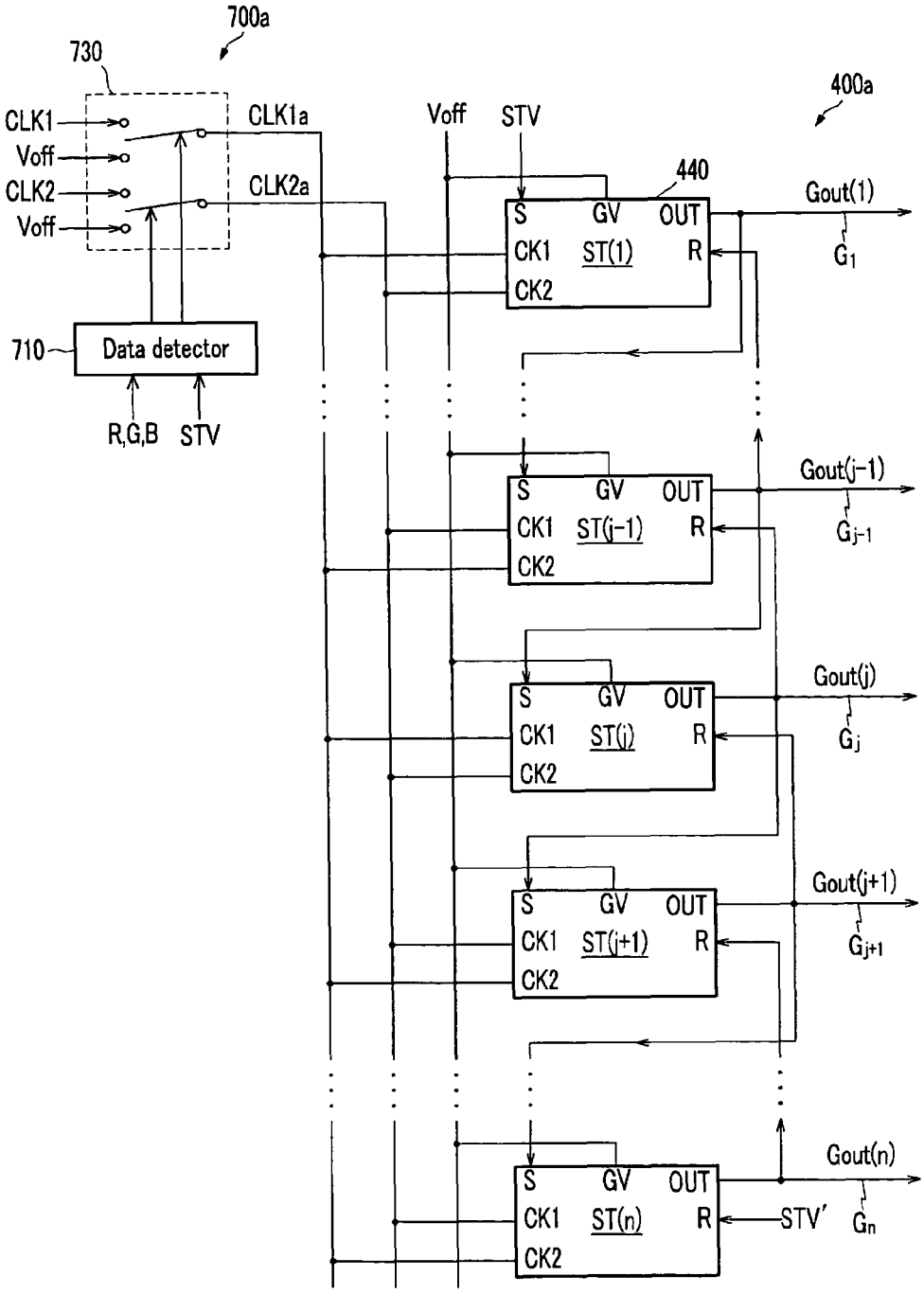
FIG. 7 is a block diagram of a gate driver and a gate driver controller according to another exemplary embodiment of the present invention.
Figure 8:
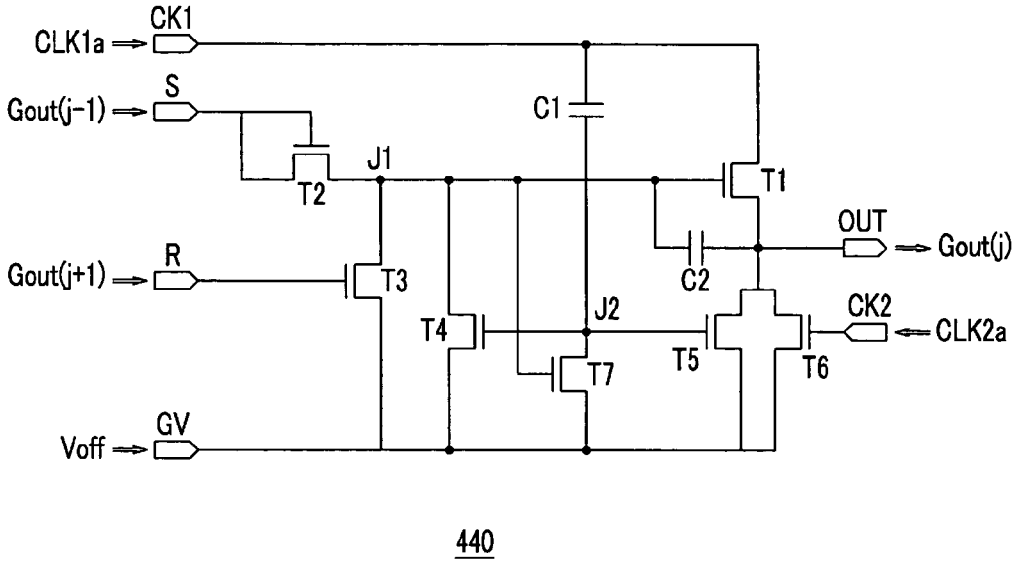
FIG. 8 is a diagram showing the j-th stage of a shift register for the gate driver shown in FIG. 7.
Figure 9:
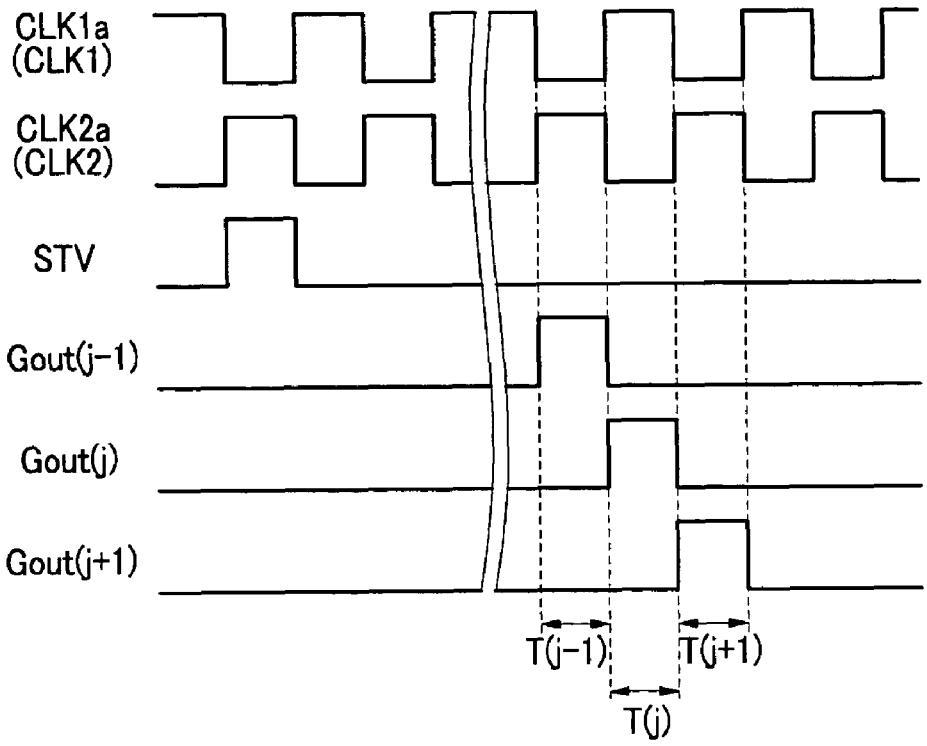
FIG. 9 and FIG. 10 are respectively signal timing diagrams of the gate driver shown in FIG. 7.
Figure 10:
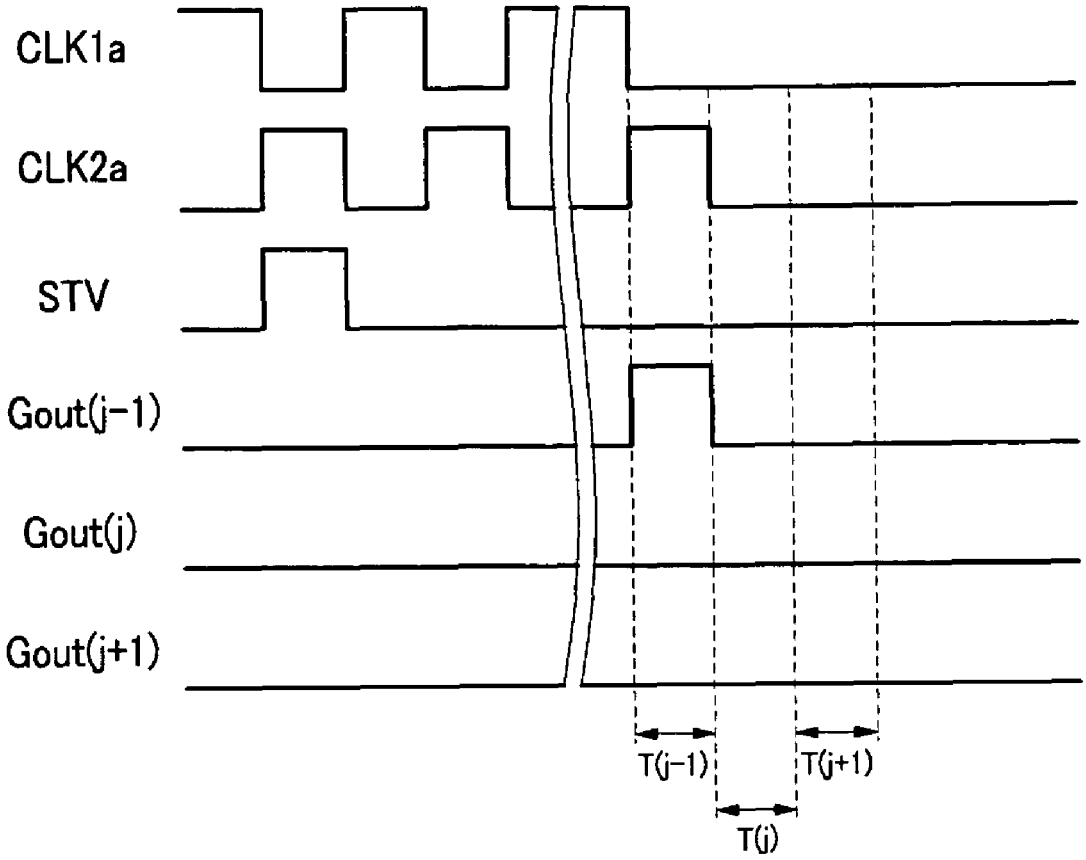

FIG. 6 is a block diagram of a liquid crystal display according to another exemplary embodiment of the present invention, and FIG. 7 is a block diagram of a gate driver and a gate driver controller according to the exemplary embodiment of the present invention. FIG. 8 is a diagram of the j-th stage of a shift register for the gate driver shown in FIG. 7. FIG. 9 and FIG. 10 are signal timing diagrams of the gate driver shown in FIG. 7.

As shown in FIG. 6 and FIG. 7, a liquid crystal display according to another exemplary embodiment of the present invention includes almost the same structure as that of the liquid crystal display shown in FIG. 1, except for a gate driver controller 700*a* and a gate driver 400*a*.

In detail, the gate driver controller 700*a* includes a data detector 710 for detecting input image signals R, G, and B input to the signal controller 600 and a scanning start signal STV output from the signal controller 600, and a clock controller 730 for receiving clock signals CLK1 and CLK2 output from the signal controller 600 and outputting control signals CLK1*a* and CLK2*a*.

The clock signals CLK1 and CLK2 have a duty ratio of about 50% and a 2H cycle, and a phase difference between the clock signals CLK1 and CLK2 is 180 degrees. Here, when the switching element Q of the pixel PX is an n-channel transistor, the high voltage of the clock signals CLK1 and CLK2 may be the same as the gate-on voltage Von and the low voltage may be the same as the gate-off voltage Voff.

The gate driver 400*a* is a shift register including a plurality of stages 440 respectively connected to the gate lines $G_1$-$G_n$, and receives the scanning start signal STV, the control signals CLK1*a* and CLK2*a*, and the gate-off voltage Voff.

Each stage 440 includes a set terminal S, a reset terminal R, a gate-off voltage terminal GV, an output terminal OUT, and clock terminals CK1 and CK2. For each stage 440, for example, the j-th stage ST(j), a gate output Gout(j−1) of the previous stage ST(j−1) is applied to the set terminal S, and the gate output Gout(j+1) of the next stage ST(j+1) is input to the reset terminal R. The gate-off voltage Voff is input to the gate-off voltage terminal GV, and the control signals CLK1*a* and CLK2*a* from the clock controller 730 are respectively input to the clock terminals CK1 and CK2. The output terminal OUT of the j-th stage ST(j) outputs the gate output Gout(j) to the gate line $G_j$ and the previous and next stages ST(j−1) and ST(j+1). Alternatively, a level shifter and/or an output buffer may be disposed between the gate line $G_j$ and the output terminal OUT.

However, the scanning start signal STV from the signal controller 600 is input to the set terminal S of the first stage ST(1), and the reset terminal R of the final stage ST(n) is supplied with a signal STV' having the high voltage after the gate output Gout(n) of the final stage ST(n) has the high voltage.

For example, when the clock terminal CK1 of the j-th stage ST(j) is supplied with the control signal CLK1*a* and the clock terminal CK2 is supplied with the control signal CLK2*a*, the clock terminals CK1 of the adjacent (j−1)th and (j+1)th stages ST(j−1) and ST(j+1) are supplied with the control signal CLK2*a*, and the clock terminals CK2 are supplied with the control signal CLK1*a*.

Referring to FIG. 8, each stage of the gate driver 400*a* according to another exemplary embodiment of the present invention, for example the j-th stage, includes a plurality of NMOS transistors T1-T7 and capacitors C1 and C2. However, PMOS transistors may be substituted for the NMOS transistors. Also, the capacitors C1 and C2 may be parasitic capacitors substantially formed between the gate and the drain/source regions of the NMOS transistors in the manufacturing process.

The transistor T1 includes a control terminal connected to a junction point J1, and transmits the control signal CLK1*a* to the output terminal OUT. The transistor T2 includes a control terminal and an input terminal commonly connected to the set terminal S, and outputs the previous gate output Gout(j−1) to the junction point J1. The transistor T3 includes a control terminal connected to the reset terminal R, and outputs the gate-off voltage Voff to the junction point J1. The transistor T4 and the transistor T5 respectively include a control terminal connected to the junction point J2, and respectively transmit the gate-off voltage Voff to the junction point J1 and to the output terminal OUT. The transistor T6 includes a control terminal connected to the clock terminal CK2 to transmit the gate-off voltage Voff to the output terminal OUT, and the transistor T7 includes a control terminal connected to the junction point J1 to transmit the gate-off voltage Voff to the junction point J2. The capacitor C1 is connected between the clock terminal CK1 and the junction point J2, and the capacitor C2 is connected between the junction point J1 and the output terminal OUT.

Next, the operation, in the first mode, of the j-th stage ST(j) shown in FIG. 8 will be described in detail with reference to FIG. 9.

After the input image signals R, G, and B have been completely input to the signal controller 600, when the data detector 710 detects the scanning start signal STV output from the signal controller 600, the clock controller 730 outputs the clock signals CLK1 and CLK2 as the control signals CLK1*a* and CLK2*a* to control the operation of the gate driver 400*a* in the first mode. Thus, each stage 440 generates the gate output Gout(j) having a high voltage pulse in synchronization with the clock signals CLK1 and CLK2 input to the clock terminals CK1 and CK2.

Firstly, it is assumed that the gate output Gout(j−1) of the previous stage ST(j−1) has the high voltage during the time T(j−1).

During the time T(j−1), the transistor T2 and the transistor T6 are turned on in response to the clock signal CLK2 of the high voltage and the gate output Gout(j−1) of the high voltage. Accordingly, the transistor T2 transmits the high voltage to the junction point J1 such that two transistors T1 and T7 are turned on. Therefore, the transistor T7 transmits the low voltage to the junction point J2, and the transistor T6 transmits the low voltage to the output terminal OUT. Also, the transistor T1 is turned on and then the clock signal CLK1 of the low voltage is output to the output terminal OUT such that the gate output Gout(j) maintains the low voltage. Simultaneously, the capacitor C2 charges to a voltage having a magnitude corresponding to a difference between the high voltage and the low voltage. Here, because the next gate output Gout(j+1) is the low voltage, the transistors T3, T4, and T5 having the control terminals connected to the reset terminal R and the junction point J2 are turned off.

Next, during the time T(j), the previous gate output Gout (j−1) and the clock signal CLK2 become the low voltage such that the transistors T2 and T6 are turned off, and the junction point J1 is floated such that the transistor T1 maintains the turned on state. Accordingly, the output terminal OUT is blocked from the gate-off voltage Voff, and is simultaneously connected to the clock signal CLK1 such that it outputs the high voltage as the gate output Gout(j). Here, a voltage corresponding to a difference between the high voltage and the low voltage charges the capacitor C1. On the other hand, the potential of one terminal of the capacitor C2 which is connected to the junction point J1 is increased to the high voltage.

Next, during the time T(j+1), the transistor T6 is turned on by the high voltage of the clock signal CLK2 such that the output terminal OUT outputs the low voltage as the gate output Gout(j). Also, as described in the time T(j), the output terminal OUT of the (j+1)th stage ST(j+1) outputs the gate output Gout(j+1) of the high voltage according to the clock signal CLK2 of the high voltage and the low voltage of the previous gate output Gout(j). Accordingly, the transistor T3 and T7 are turned on by the high voltage of the gate output Gout(j+1) such that the capacitors C1 and C2 are discharged.

As above-described in the time T(j+1), the output terminal OUT of the (j+1)th stage ST(j+1) outputs the gate output Gout(j+1) of the low voltage after the time T(j+1). Thus, the transistors T2 and T3 are turned off by the low voltage of the previous and next gate outputs Gout(j−1) and Gout(j+1) such that the junction points J1 and J2 are floated. Accordingly, if the clock signal CLK1 becomes the high voltage, the junction point J1 that is floated becomes the high voltage by the capacitor C1 such the transistor T5 is turned on, and the output terminal OUT maintains the low voltage. Also, if the clock signal CLK2 becomes the high voltage, the transistor T6 is turned on such that the output terminal OUT maintains the low voltage. Accordingly, the output terminal OUT outputs the gate output Gout(j) of the low voltage after the time T(j+1).

In this way, the gate output of the high voltage is sequentially generated from the first stage ST(1) to the final stage ST(n) and may be applied to the gate lines $G_1$-$G_n$.

Next, the operation in the second mode of the j-th stage ST(j) shown in FIG. 8 will be described in detail with reference to FIG. 10.

When the data detector 710 detects that the input image signals R, G, and B are input to the signal controller 600, the clock controller 730 outputs control signals CLK1*a* and CLK2*a* having the low voltage Voff to control the operation of the gate driver 400*a* with the second mode.

Here, it is assumed that the (j−1)th gate output Gout(j−1) has the high voltage in the time T(j−1) and the control signals CLK1*a* and CLK2*a* have the low voltage from the time T(j).

Thus, the transistor T1 is turned on by the high voltage at the junction point J1 in the floated state during the time T(j) and the output terminal OUT is connected by the transistor T1 to the control signal CLK1*a* and outputs the low voltage as the gate output Gout(j).

Next, because the control signals CLK1*a* and CLK2*a* are continuously at the low voltage after the time T(j+1), the transistor T1 is maintained in the turned on state by the junction point J1 which is in the floating state. Accordingly, the output terminal OUT continuously outputs the low voltage as the gate output Gout(j).

Then, because the gate output Gout(j) and the control signals CLK1*a* and CLK2*a* are all at the low voltage in the time T(j+1), the output terminal OUT of the (j+1)th stage ST(j+1) also outputs the gate output Gout(j+1) of the low voltage.

In this way, the gate output of the low voltage is generated from the j-th stage ST(j) to the final stage ST(n) such that the switching element Q of the pixel PX is turned off. Thus, the pixel PX displays the gray level of the data voltage stored to the liquid crystal capacitor Clc and the storage capacitor Cst in the previous frame.

In the exemplary embodiments of the present invention, it has been assumed that the switching element Q is an n-channel transistor and the gate voltage and therefore, when the display is operated in the second mode, Vg in one embodiment or the control signals CLK1*a* and CLK2*a* in another embodiment are set at the low voltage, but when the switching element Q is a p-channel transistor, the gate voltage Vg or the control signals CLK1*a* and CLK2*a* may be set at the high voltage.

Also, in the exemplary embodiments of the present invention, the shift registers shown in FIG. 3, FIG. 7, and FIG. 8 have been explained as examples, but shift registers of different types may be used as the gate driver.

According to an exemplary embodiment of the present invention, even when new input image signals are input to the signal controller, the tearing phenomenon in which previous images and new images are displayed in one screen may be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A driving apparatus of a display device including a plurality of pixels respectively having a switching element and displaying images according to data signals, and a plurality of gate lines and data lines respectively connected to the pixels, the driving apparatus comprising:

a data driver configured to generate data signals corresponding to input image signals to apply to the data lines;

a gate driver configured to sequentially scan a gate-on voltage to the gate lines to turn on the switching elements in a first mode, and stop sequential scanning of the gate-on voltage in a second mode;

a signal controller configured to receive, process and transmit the input image signals to the data driver, and to transmit a control signal to the gate driver; and a gate driver controller coupled between the signal controller and the gate driver, the gate driver controller being configured to detect image signals that are directly input to the signal controller, the display device being in the first mode when the gate driver controller determines that no new image signals are being directly input to the signal controller, the display device being in the second mode when the gate driver controller determines that at least some new input image signals are being directly input to the signal controller while an image associated with previous input image signals is being displayed.

2. The driving apparatus of claim 1, wherein the gate driver controller provides a gate voltage and a gate-off voltage to the gate driver, wherein in the first mode, the gate driver controller sets the gate voltage as the gate-on voltage, and in the second mode the gate driver controller sets the gate voltage as a first voltage to turn off the switching elements.

3. The driving apparatus of claim 2, wherein:

in the first mode, the gate driver applies a gate signal comprising the gate-off voltage followed by the gate-on voltage followed by the gate-off voltage to each gate line; and in the second mode the first voltage is substantially equal to the gate-off voltage.

4. The driving apparatus of claim 1, wherein:

the signal controller outputs a clock signal alternately having a high voltage and a low voltage;

the gate driver controller transmits the clock signal to the gate driver only in the first mode; and the gate driver generates the gate-on voltage in synchronization with the clock signal.

5. The driving apparatus of claim 4, wherein in the second mode the gate driver controller provides to the gate driver a signal having a constant voltage.

6. The driving apparatus of claim 5, wherein the constant voltage is a first voltage for turning off the switching elements.

7. The driving apparatus of claim 1, wherein:

the control signal includes a scanning start signal; and the gate driver controller controls an operation of the gate driver in the first mode when an input of the input image signals to the signal controller is completed and the scanning start signal is output from the signal controller.

8. The driving apparatus of claim 7, wherein the gate driver controller controls the gate driver in the second mode before the scanning start signal is output from the signal controller after the input of the input image signals to the signal controller is completed.

9. The driving apparatus of claim 1, wherein the gate driver controller directly detects whether the input image signals are input to the signal controller.

10. The driving apparatus of claim 1, wherein:

the signal controller receives and writes the input image signals in response to a write signal; and the gate driver controller detects input of the input image signals by detecting whether the write signal is input to the signal controller.

11. The driving apparatus of claim 1, wherein:

the signal controller receives and writes the input image signals in response to a register selection signal; and the gate driver controller detects input of the input image signals by detecting whether the register selection signal is input to the signal controller.

12. A display device comprising:

a signal controller configured to receive and store input image signals;

a data driver configured to generate a data signal corresponding to the input image signals transmitted from the signal controller;

a data line for transmitting the data signal;

a gate line for transmitting a gate signal;

a pixel configured to receive and store the data signal from the data line, and display images corresponding to the data signal responsive to receipt of the gate signal; and a gate driver configured to prevent the pixel from receiving a new data signal associated with new input image signals when the new input image signals are being directly input to the signal controller.

13. The display device of claim 12, wherein:

the pixel receives the data signal while the gate driver sets the gate signal as a gate-on voltage; and the gate driver stops setting the gate-on voltage while the new input image signals are input to the signal controller.

14. The display device of claim 13, wherein:

the pixel includes a switching element that is turned on in response to the gate-on voltage to receive the data signal; and the gate driver sets the voltage of the gate signal as a first voltage for turning off the switching element to stop applying the gate-on voltage while the new input image signals are input to the signal controller.

15. The display device of claim 14, wherein:

the gate driver generates the gate signal composed of a combination of a second voltage for turning off the switching element and the gate-on voltage, or a combination of the first voltage and the second voltage; and the gate signal is composed of the first voltage and the second voltage while the new input image signals are input to the signal controller.

16. The display device of claim 15, wherein the first voltage is the same as the second voltage.

17. The display device of claim 13, wherein:

the signal controller outputs a clock signal alternately having a high voltage and a low voltage;

the gate driver generates the gate signal having the gate-on voltage in synchronization with the clock signal when receiving the clock signal; and the display device further includes a gate driver controller applying a signal having constant voltage to the gate driver while the new input image signals are input to the signal controller.

18. A driving method of a display device, comprising:

storing a first data signal corresponding to first input image signals to a pixel;

displaying an image according to the stored first data signal;

receiving second input image signals at a signal controller;

preventing a second data signal corresponding to the second input image signals from being transmitted to the pixel when the second input image signals are being directly input to the signal controller;

continuously displaying the image according to the stored first data signal while the second input image signals are being directly input to the signal controller;

transmitting the second data signal to the pixel after the second input image signals have been completely input to the signal controller;

displaying a new image according to the second data signal after completion of the receiving of the second input image signals at the signal controller; and outputting a clock signal alternately having a high voltage and a low voltage, wherein the storing of the first data signal includes transmitting the clock signal to the gate driver, and the continuous displaying of the image includes stopping transmitting the clock signal to the gate driver.

19. The driving method of claim 18, wherein the gate driver sets the pixel to store the first data signal in synchronization with the clock signal.

20. The driving method of claim 19, wherein the stopping of transmitting further includes providing a signal having a constant voltage to the gate driver in substitution for the clock signal.

21. The driving method of claim 18, wherein the displaying of the image includes the image according to the second data signal when a scanning start signal for informing of scanning start is output after the receiving of the second input image signals is completed.

22. The driving method of claim 21, wherein the image is continuously displayed according to the first data signal before the scanning start signal is output after the receiving of the second input image signals is completed.

23. The driving method of claim 18, wherein the receiving of the second input image signals includes determining whether the second input image signals are received by directly detecting the receiving of the second input image signals.

24. The driving method of claim 18, wherein the receiving of second input image signals includes receiving and writing the second input image signals in response to a write signal, and determining whether the second input image signals are received by detecting the input of the write signal.

* * * * *